US005244249A

United States Patent [19]

Tseng

[11] Patent Number: 5,244,249

[45] Date of Patent: Sep. 14, 1993

[54] LAWN CHAIR

[76] Inventor: Chun-Chu Tseng, No. 3, Ting-Hsi-Hsin, Lu-Man Ts'un, Chu-Chi Hsiang, Chiayi Hsien, Taiwan

[21] Appl. No.: 939,301

[22] Filed: Sep. 2, 1992

[51] Int. Cl.[5] ..... A47C 4/28

[52] U.S. Cl. ..... 297/58; 297/19; 297/220; 297/391; 297/DIG. 6

[58] Field of Search ..... 297/19, 23, 55, 58, 297/219, 220, 391, DIG. 6

[56] References Cited

U.S. PATENT DOCUMENTS

| | | | |
|---|---|---|---|
| 795,188 | 7/1905 | Barratt | 297/19 |
| 1,404,449 | 1/1922 | Lahm | 297/19 |
| 2,177,186 | 10/1939 | Nordmark | 297/58 |
| 2,207,338 | 7/1940 | Clarin | 297/58 |
| 2,211,289 | 8/1940 | Orton | 297/58 |
| 4,003,599 | 1/1977 | Takamatsu | 297/391 X |
| 4,014,591 | 3/1977 | Gittings | 297/55 |
| 4,906,042 | 3/1990 | Ollat | 297/19 |
| 5,154,477 | 10/1992 | Tseng | 297/DIG. 6 X |

FOREIGN PATENT DOCUMENTS

| | | | |
|---|---|---|---|
| 30275 | 10/1907 | Austria | 297/23 |
| 207522 | 2/1960 | Austria | 297/19 |
| 2317894 | 2/1977 | France | 297/19 |
| 13596 | 6/1908 | United Kingdom | 297/23 |

*Primary Examiner*—Lloyd A. Gall
*Attorney, Agent, or Firm*—Willian Brinks Olds Hofer Gilson & Lione

[57] ABSTRACT

A lawn chair includes a main frame assembly, a pillow frame, a pillowcase, a rear leg frame, a seat frame assembly, two elongated adjustment members and two positioning rods. The main frame assembly includes a backrest frame, a front leg frame and a curved first supporting rod mounted pivotally on the backrest frame at two ends thereof. The pillow frame is attached to an upper end portion of the backrest frame and is covered by the pillowcase. The rear leg frame is connected pivotally to an upper end portion of the front leg frame. The seat frame assembly includes two parallel straight rods connected pivotally to an intermediate portion of the rear leg frame at rear end portions thereof, and a curved second supporting rod mounted pivotally on front end portions of the straight rods at two ends thereof. Each of the elongated adjustment members has a front end portion connected pivotally to an intermediate portion of the front leg frame and formed with a longitudinal slot which has a row of L-shaped positioning portions. Each of the two positioning rods is secured to the seat frame assembly at one end thereof and extends through a selected one of the L-shaped positioning portions of the longitudinal slot at the other end.

6 Claims, 6 Drawing Sheets

LAWN CHAIR

BACKGROUND OF THE INVENTION

1. Field Of The Invention

This invention relates to a lawn chair, more particularly to a lawn chair in which the angle between the backrest and the seat of the chair can be adjusted when the lawn chair is in use.

2. Description Of The Related Art

Referring to FIG. 1, a conventional lawn chair (1) is shown to comprise an inverted U-shaped backrest frame (11), a seat frame (12), two aligned armrests (13), a U-shaped front leg frame (14) and a U-shaped rear leg frame (15).

A backrest cushion (111) is provided on the backrest frame (11). The backrest frame (11) has a lower end which is secured pivotally to the seat frame (12). A seat cushion (121) is provided on the seat frame (12). Each of the aligned armrests (13) is secured pivotally to the backrest frame (11) at one end thereof. The other end of each of the aligned armrests (13) is secured pivotally to the front leg frame (14). A middle portion of each of the aligned armrests (13) is secured pivotally to the rear leg frame (15). The front leg frame (14) has an upper portion which is secured pivotally to the seat frame (12). The rear leg frame (15) has an upper portion which is secured pivotally to the seat frame (12) at the position where the lower end of the backrest frame (11) is secured to.

The drawback of the above-described conventional lawn chair (1) is that the angle between the backrest frame (11) and the seat frame (12) cannot be adjusted when the lawn chair (1) is in use. Moreover, the back and the legs of the user rest against horizontal shafts (112, 122) of the backrest frame (11) and the seat frame (12), thereby causing discomfort to the user. Additionally, the above-described conventional lawn chair (1) does not have a head cushion for the user.

SUMMARY OF THE INVENTION

Therefore, the main object of this invention is to provide a lawn chair in which the angle between the backrest portion and the seat portion can be adjusted when the lawn chair is in use.

Another object of this invention is to provide a lawn chair which has a minimizes the discomfort felt by the user when the body of the user leans against the chair frame when the lawn chair is in use.

A further object of this invention is to provide a lawn chair which has a head cushion.

According to this invention, a lawn chair includes a main frame assembly, a pillow frame, a pillowcase, a rear leg frame, a seat frame assembly, two elongated adjustment members, two positioning rods and a chair cover. The main frame assembly includes a backrest frame, a front leg frame and a curved first supporting rod being mounted pivotally on the backrest frame at two ends thereof. The pillow frame is attached to an upper end portion of the backrest frame and is covered by the pillowcase. The rear leg frame is connected pivotally to an upper end portion of the front leg frame. The seat frame assembly includes two parallel straight rods connected pivotally to an intermediate portion of the rear leg frame at rear end portions thereof, and a curved second supporting rod mounted pivotally on front end portions of the straight rods at two ends thereof. Each of the elongated adjustment member has a front end portion connected pivotally to an intermediate portion of the front leg frame and formed with a longitudinal slot formed which has a row of L-shaped positioning portions. Each of the two positioning rods is secured to the seat frame assembly at one end thereof and extends through a selected one of the L-shaped positioning portions of the longitudinal slot at the other end thereof. The positioning rod is movable into another one of the L-shaped portions of the longitudinal slot so as to change an angle between the backrest frame and the seat frame assembly. The chair cover has a backrest portion and a seat portion which covers the backrest frame of the main frame assembly and a seat portion which covers the seat frame assembly.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
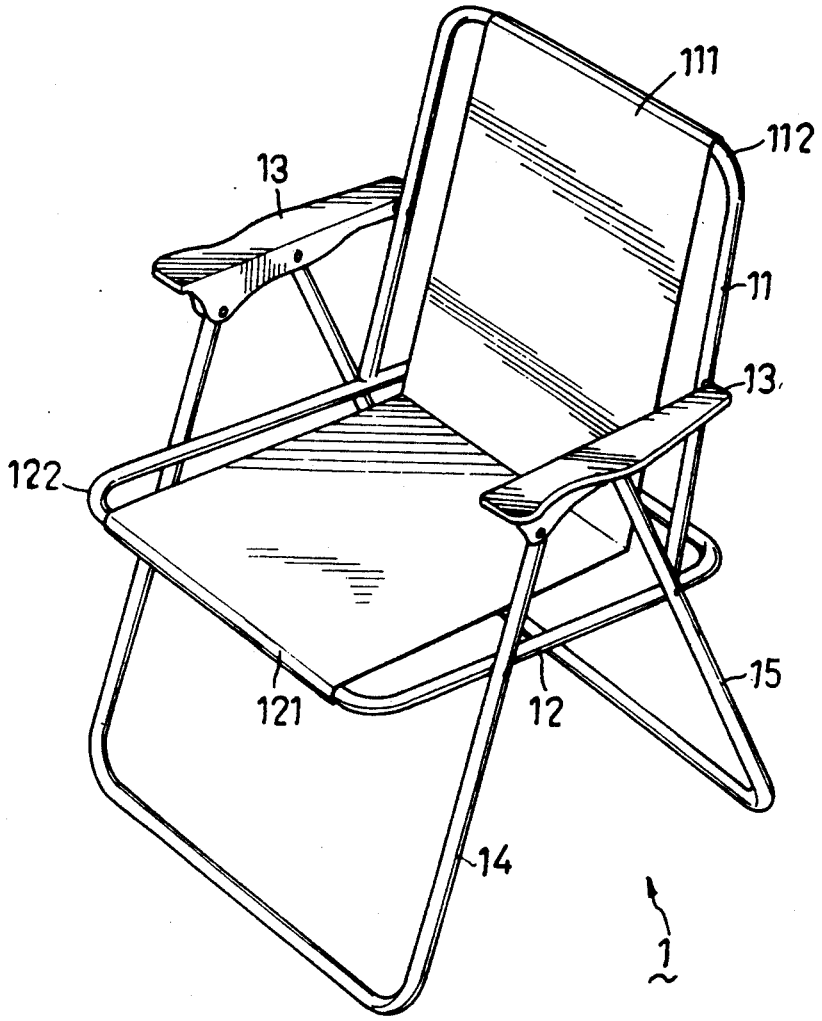
FIG.1 PRIOR ART
FIG. 1 is a perspective view of a conventional lawn chair.
Figure 2:
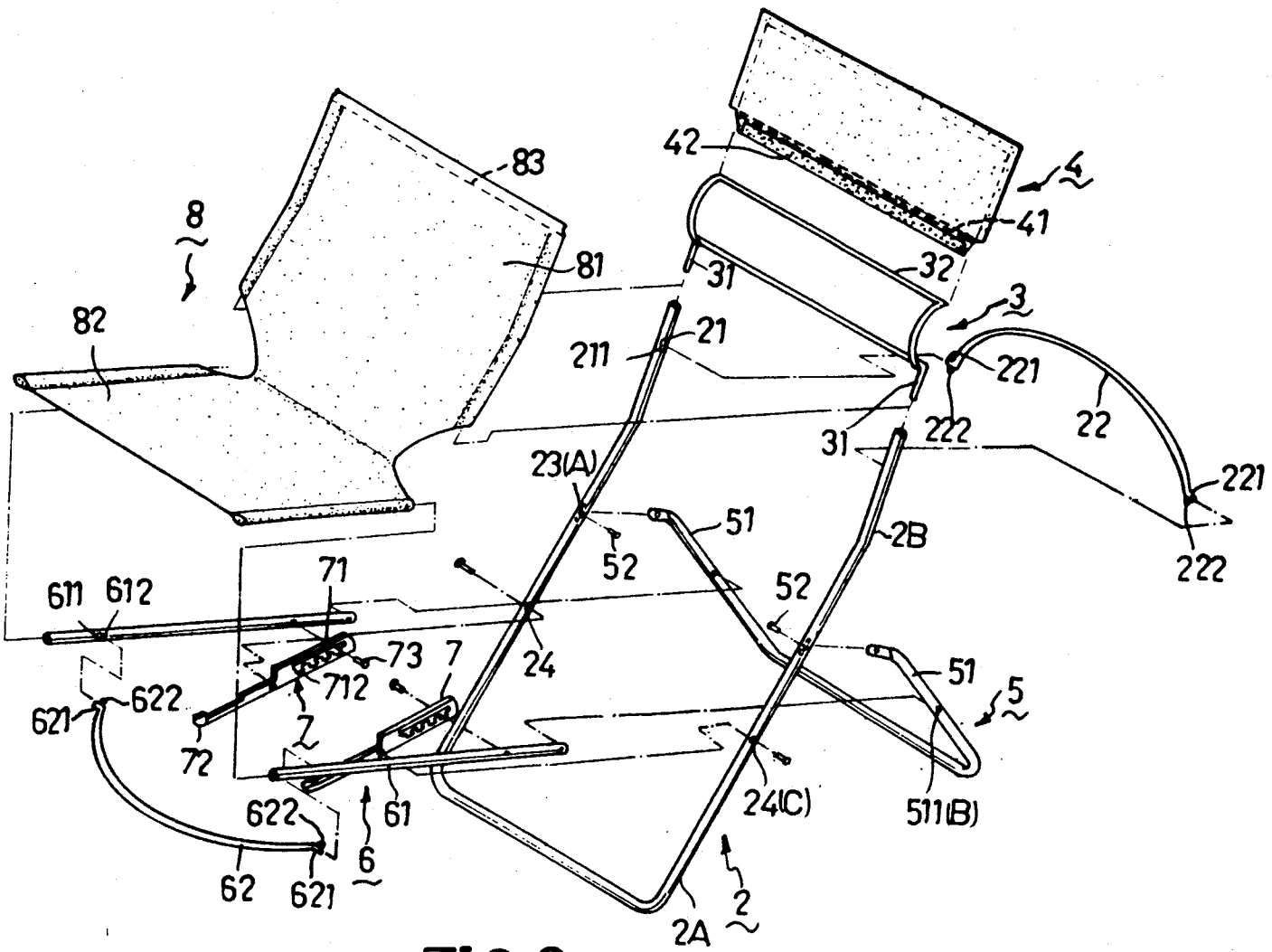
FIG. 2 is a exploded view of a lawn chair according to this invention.
Figure 2A:
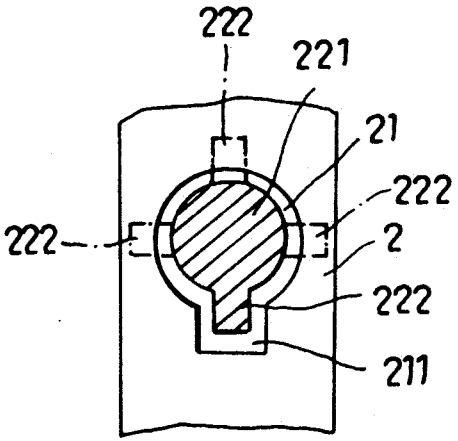
FIG. 2A is an enlarged partial perspective view showing the connection between a backrest frame and a curved first supporting rod.
Figure 3:
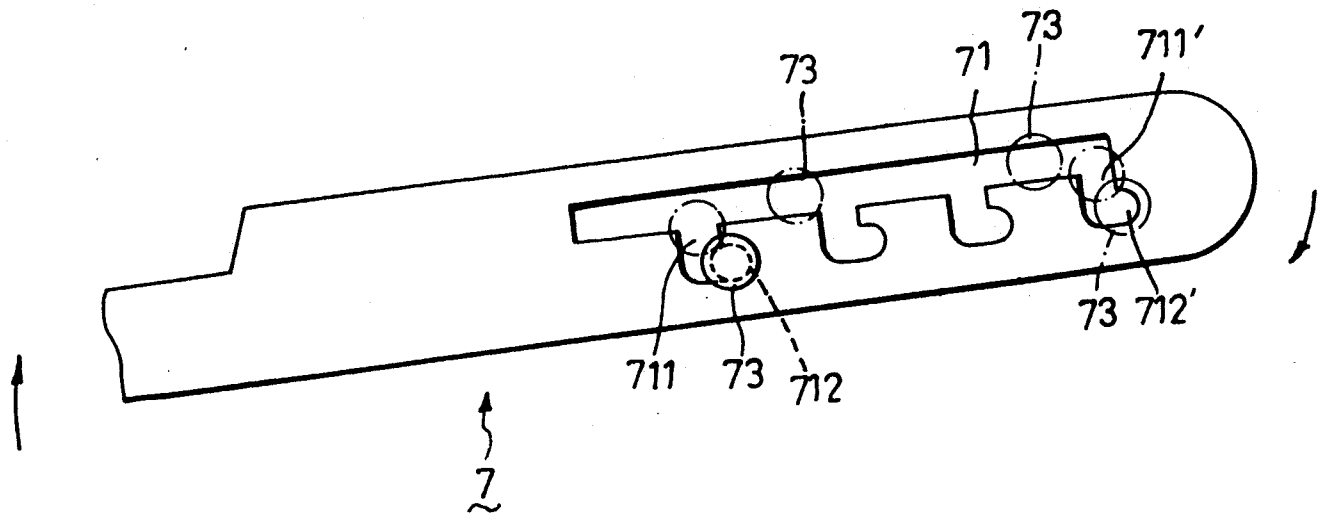
FIG. 3 is an enlarged perspective view showing the movement of a positioning rod in an adjustment member.

Referring to FIGS. 2, 2A and 3, a lawn chair according to this invention includes a main frame assembly (2), a pillow frame (3), a pillowcase (4), a rear leg frame (5), a seat frame assembly (6), two elongated adjustment members (7), two positioning rods (73) and a chair cover (8).

The main frame assembly (2) includes a front leg frame (2A), a backrest frame (2B) and a curved first supporting rod (22).

The backrest frame (2B) is disposed at an upper part of the main frame assembly (2) and has two generally vertical tubular portions and two aligned first holes (21) formed in the tubular portions of the backrest frame (2B). Each of the first holes (21) of the backrest frame (2B) has a radial extension portion (211). The curved first supporting rod (22) extends through the first holes (21) of the backrest frame (2B) at two end portions (221) thereof and has a projection (222) which projects radially from each end of the first supporting rod (22) in the tubular portions of the backrest frame (2B). The projections (222) are not aligned with the extension portions (211) so as to prevent the removal of the first supporting rod (22) from the backrest frame (2B). The first supporting rod (22) is rotated relative to the backrest frame (2B) in order to align the projections (222) with the extension portions (211), thereby permitting passage of the projections (222) through the extension portion (211) so as to remove the first supporting rod (22) from the backrest frame (2B).

The front leg frame (2A) is formed integrally with a lower end portion of the backrest frame (2B) at an upper end portion of the front leg frame (2A). Two aligned second holes (23) are formed in an intermediate position between the lower end portion of the backrest frame (2B) and the upper end portion of the front leg frame (2A). The front leg frame (2A) has two aligned third holes (24) formed therethrough in an intermediate portion thereof.

The pillow frame (3) is a rectangular frame which is formed by welding a plurality of metallic tubes. The pillow frame (3) has a pair of connecting legs (31), which extend outwards from a lower end of the pillow frame (3), and a portion (32).

The pillowcase (4) covers the portion (32) of the pillow frame (3) and has a back side and a front side. A zipper (41) is provided on a lower end of the back side of the pillowcase (4). A hook and loop fastener (42) is provided on a lower end of the front side of the pillowcase (4). The pillowcase (4) is preferably made of a textile fabric.

The rear leg frame (5) is a U-shaped frame with two flat ends. The rear leg frame (5) has two vertical portions (51). Each of the two vertical portions (51) has a receiving hole (511) formed therein. The two receiving holes (511) of the two vertical portions (511) are aligned with each other. The rear leg frame (5) is connected pivotally to the lower end portion of the backrest frame (2B) by two rivets (52) which extend through the two flat ends of the rear leg frame (5) and through the second holes (23) at the lower end portion of the backrest frame (2B).

The seat frame assembly (6) includes two parallel straight rods (61) and a second curved supporting rod (62). Each of the two straight rods (61) of the seat frame assembly (6) has a generally tubular portion and are connected pivotally to the two receiving holes (511) of the two vertical portions (51) of the rear leg frame (5) at one end and has a hole (611) formed at the other end. Each of the holes (611) of the straight rods (61) has a radial extension portion (612). The second supporting rod (62) extends through the holes (611) of the straight rods (61) at two end portions (621) thereof and has a projection (622) projecting radially from each end in the tubular portions of the two straight rods (61). The projections (622) are not aligned with the extension portions (612) so as to prevent the removal of the second supporting rod (62) from the straight rods (61) of the seat frame assembly (6). The second supporting rod (62) is rotated relative to the two straight rods (61) of the seat frame assembly (6) in order to align the projections (622) with the extension portions (612), thereby permitting the passage of the projections (622) through the extension portion (612) so as to remove the second supporting rod (62) from the straight rods (61) of the seat frame assembly (6).

Each of the elongated adjustment members (7) has a front end portion connected pivotally to one of the third holes (24) of the front leg frame (2A). Each of the two elongated adjustment members (7) further has a longitudinal slot (71) formed therethrough. The longitudinal slot (71) has a row of L-shaped positioning portions. Each of the L-shaped positioning portions has a vertical part (711) and a horizontal part (712). Each of the two elongated adjustment members (7) has a handle (72) which extends from the front end portion.

Each of the two positioning rods (73) is secured to one of the two straight rods (61) of the seat frame assembly (6) at one end thereof and extends through a selected one of the L-shaped positioning portions of the longitudinal slot (71) at the other end. The positioning rod (73) is movable into another one of the L-shaped portions of the longitudinal slot (71) so as to change an angle ($\beta$) [see FIGS. 4 and 5] between the backrest frame (2B) and the seat frame assembly (6).

The chair cover (8) is made of canvas. The cover (8) has an upper portion (81) and a lower portion (82). The upper portion (81) covers the backrest frame (2B) of the main frame assembly (2A). The lower portion (82) covers the straight rods (61) of the seat frame assembly (6). A hook and loop fastener (83) is provided on the upper end of the cover (8) so as to couple the cover (8) with the pillowcase (4).

Figure 4:
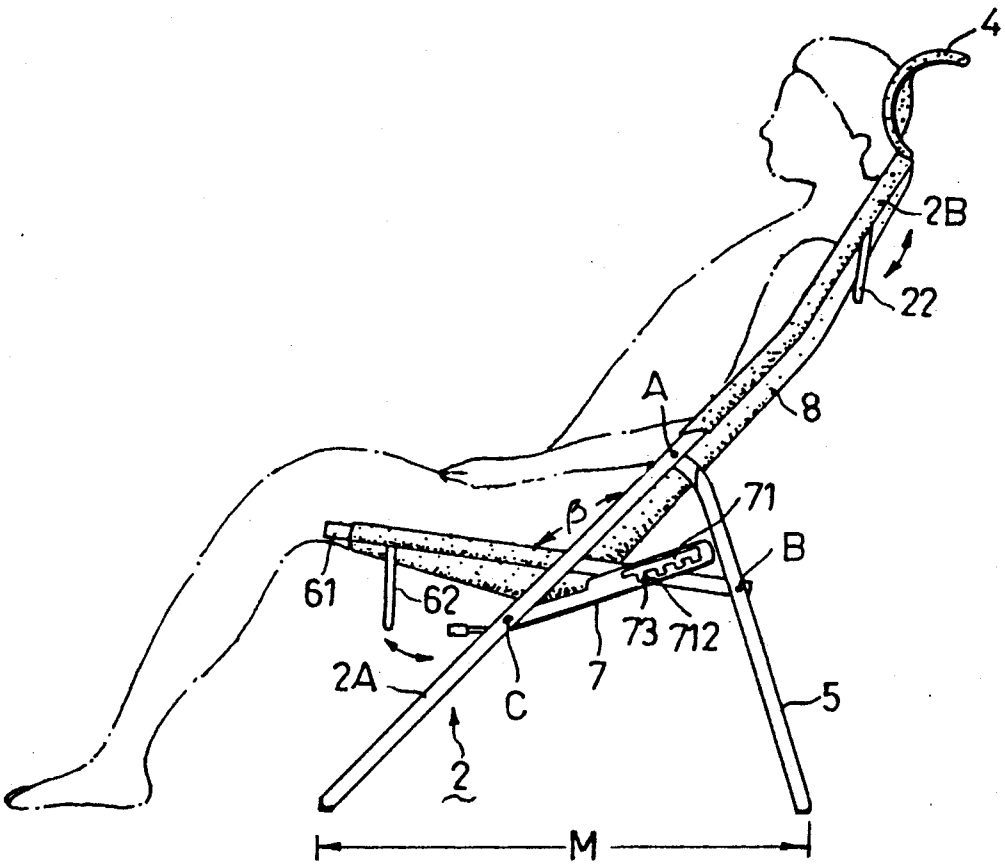
FIG. 4 is a side view of the lawn chair according to this invention when in use.

Referring to FIGS. 3 and 4, when the lawn chair according to this invention is in use, the positioning rods (73) engage the horizontal part (712) of the selected L-shaped positioning portion of the slot (71). In this manner, the front leg frame (2A) and the rear leg frame (5) are M inches apart so as to form an angle ($\beta$) between the backrest frame (2B) and the seat frame assembly (6). The first curved supporting rod (22) and the second curved supporting rod (62) provide a good support for the chair. Furthermore, the first curved supporting rod (22) and the second curved supporting rod (62) can be moved pivotally so as to reduce the force against the body and legs of the user. The pillow frame (3) is covered by the pillowcase (4) and serves as a head cushion for the user.

Figure 5:
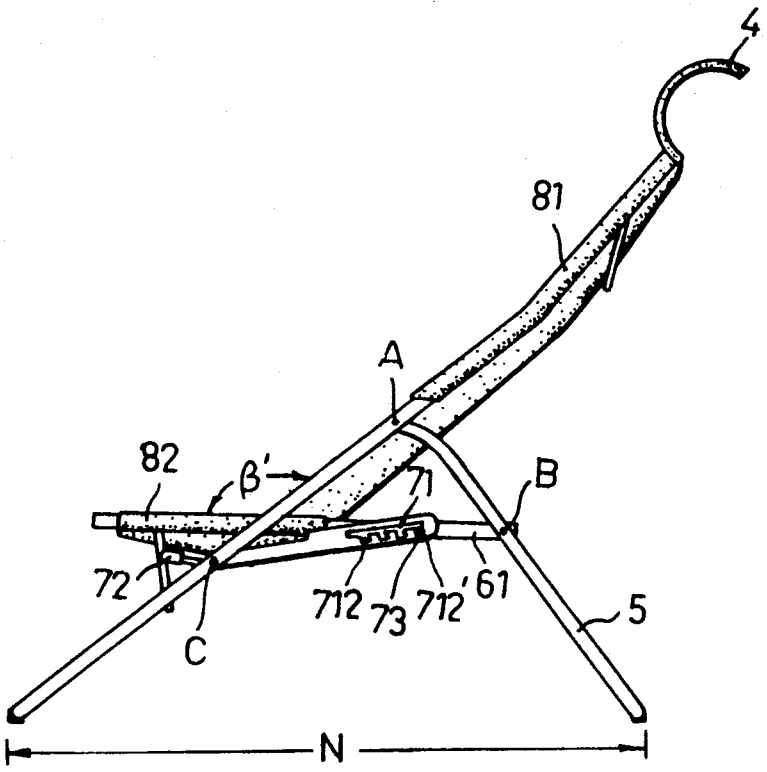
FIG. 5 a side view showing the adjustment of the angle between the backrest portion and the seat portion.

Referring to FIGS. 3 and 5, the angle ($\beta$) between the backrest frame (2B) and the seat frame assembly (6) can be adjusted. The positioning rod (73) is firstly removed from the horizontal part (712) of the L-shaped positioning portion to the vertical part (711) of the L-shaped positioning portion. The handle (72) of the adjustment member (7) is then pulled upwards, and the adjustment member (7) is rotated about a point (C) so as to move the positioning rod (73) from the vertical portion (711) of the L-shaped positioning portion to the longitudinal slot (71). Afterwards, the straight rod (61) of the seat frame assembly (6) is rotated about a point (B) and the rear leg frame (5) is rotated about a point (A) simultaneously so as to move the positioning rod (73) in the slot (71) to a vertical part (711') of a selected L-shaped positioning portion. The handle (72) of the adjustment member (7) is pressed downwards, and the straight rod (61) of the seat frame assembly (6) is rotated about the point (B) while the rear leg frame (5) is rotated about the point (A) simultaneously so as to move the positioning rod (73) from the vertical portion (711') to the horizontal portion (712') of the L-shaped positioning portion again. In this manner, the front leg frame (2A) and the rear leg frame (5) are N inches ($N>M$) apart so as to form a greater angle ($\beta'$) between the backrest frame (2B) and the seat frame assembly (6).

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A lawn chair, comprising:

a main frame assembly including a backrest frame, a front leg frame having an upper end portion which is integrally formed with a lower end portion of said backrest frame, and a curved first supporting rod mounted pivotally on said backrest frame at two ends thereof;

a pillow frame attached to an upper end portion of said backrest frame;

a pillowcase covering said pillow frame;

a rear leg frame connected pivotally to the upper end portion of said front leg frame;

a seat frame assembly including two parallel straight rods connected pivotally to an intermediate portion of said rear leg frame at rear end portions thereof, and a curved second supporting rod mounted pivotally on front end portions of said straight rods at two ends thereof;

two elongated adjustment members, each of said elongated adjustment members having a front end portion connected pivotally to an intermediate portion of said front leg frame and formed with a longitudinal slot which has a row of L-shaped positioning portions;

two positioning rods, each of said positioning rods being secured to said seat frame assembly at one end thereof and extending through a selected one of said L shaped positioning portions of said longitudinal slot at the other end thereof, each said positioning rod being movable into another one of said L-shaped portions of said longitudinal slot to change an angle between said backrest frame and said seat frame assembly; and a chair cover having a backrest portion and a seat portion, said backrest portion of said chair cover covering said backrest frame of said main frame assembly, said seat portion of said chair cover covering said seat frame assembly.

2. A lawn chair as claimed in claim 1, wherein said pillowcase is made of a textile fabric.

3. A lawn chair as claimed in claim 2, wherein said pillowcase has a zipper provided on a back side thereof.

4. A lawn chair as claimed in claim 2, wherein said pillowcase has a hook and loop fastener provided on a front side thereof, and said backrest portion of said chair cover has a hook and loop fastener provided thereon so as to couple said pillowcase with said chair cover.

5. A lawn chair as claimed in claim 1, wherein said backrest frame has two generally vertical tubular portions, and two aligned holes formed therein, each of said holes of said backrest frame having a radial extension portion, said first supporting rod extending through said holes of said backrest frame at two end portions thereof and having a projection which projects radially from each end in said tubular portions of said backrest frame, said projections being not aligned with said extension portions so as to prevent removal of said first supporting rod from said backrest frame, said first supporting rod being rotated relative to said backrest frame in order to align said projections with said extension portions so as to permit passage of said projections through said extension portions to remove said first supporting rod from said backrest frame.

6. A lawn chair as claimed in claim 1, wherein each of said two straight rods of said seat frame assembly has a generally tubular portion and a hole formed therein, each of said holes of said straight rods having a radial extension portion and being aligned with the other, said second supporting rod extending through said holes of said straight rods at two end portions thereof and having a projection which projects radially from each end in said tubular portions of said straight rods, said projections being not aligned with said extension portions so as to prevent removal of said second supporting rod from said straight rods of said seat frame assembly, said second supporting rod being rotated relative to said straight rods of said seat frame assembly in order to align said projections with said extension portions so as to permit passage of said projections through said extension portions to remove said second supporting rod from said straight rods of said seat frame assembly.

* * * * *